US011123619B2

(12) United States Patent
Kline et al.

(10) Patent No.: US 11,123,619 B2
(45) **Date of Patent: *Sep. 21, 2021**

(54) GOLF CLUB HEAD WITH INTERIOR WEIGHT ADJUSTABLE IN MULTIPLE DIRECTIONS

(71) Applicant: Sumitomo Rubber Industries, Ltd., Hyogo (JP)

(72) Inventors: Michael J. Kline, Huntington Beach, CA (US); John Rae, Huntington Beach, CA (US); Pat Ripp, Huntington Beach, CA (US)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/550,965

(22) Filed: Aug. 26, 2019

(65) Prior Publication Data

US 2019/0374829 A1 Dec. 12, 2019

Related U.S. Application Data

(60) Continuation of application No. 15/987,520, filed on May 23, 2018, now Pat. No. 10,398,954, which is a continuation of application No. 15/296,964, filed on Oct. 18, 2016, now Pat. No. 9,987,535, which is a division of application No. 14/488,140, filed on Sep. 16, 2014, now abandoned.

(51) Int. Cl.

| | |
|---|---|
| ***A63B 60/04*** | (2015.01) |
| ***A63B 53/06*** | (2015.01) |
| ***A63B 53/04*** | (2015.01) |
| ***A63B 53/08*** | (2015.01) |
| ***A63B 71/06*** | (2006.01) |

(52) U.S. Cl.

CPC ..... *A63B 60/04* (2015.10); *A63B 53/0466* (2013.01); *A63B 53/06* (2013.01); *A63B 53/08* (2013.01); *A63B 2053/0491* (2013.01); *A63B 2071/0694* (2013.01); *A63B 2220/10* (2013.01); *A63B 2220/13* (2013.01); *A63B 2220/30* (2013.01); *A63B 2220/34* (2013.01); *A63B 2225/50* (2013.01)

(58) Field of Classification Search

CPC ..... A63B 60/04; A63B 53/0466; A63B 53/06; A63B 53/08; A63B 2053/0491; A63B 2071/0694; A63B 2220/10; A63B 2220/13; A63B 2220/30; A63B 2220/34; A63B 2225/50; A63B 60/02

USPC ..... 473/335, 345

See application file for complete search history.

(56) References Cited

U.S. PATENT DOCUMENTS

| | | | |
|---|---|---|---|
| 3,610,630 | A | 10/1971 | Glover |
| 4,607,846 | A | 8/1986 | Perkins |

(Continued)

*Primary Examiner* — Michael D Dennis

(74) *Attorney, Agent, or Firm* — Stetina Brunda Garred & Brucker

(57) ABSTRACT

A golf club head includes a striking face, and a body coupled to the striking face. The body includes a crown, a sole disposed in generally opposed relation to the crown, and a back extending away from the striking face. The striking face and body collectively define a hollow interior chamber. A weight is disposed entirely within the interior chamber. An adjustment mechanism is coupled to the body and the weight to enable external adjustment of the weight along three axes.

16 Claims, 3 Drawing Sheets

(56) References Cited

U.S. PATENT DOCUMENTS 5,013,041 A 5/1991 Sun et al.
5,464,211 A 11/1995 Atkins, Sr.
5,788,587 A 8/1998 Tseng
5,890,973 A * 4/1999 Gamble ..... A63B 53/0466 473/326
6,171,204 B1 1/2001 Starry
6,364,788 B1 * 4/2002 Helmstetter ..... A63B 60/00 473/324
6,386,987 B1 5/2002 Lejeune, Jr.
6,443,855 B1 9/2002 Tseng
7,156,752 B1 1/2007 Bennett
7,344,450 B2 3/2008 Billings
7,351,161 B2 * 4/2008 Beach ..... A63B 53/0466 473/334
9,072,951 B1 * 7/2015 Tang ..... A63B 53/0466
9,101,811 B1 8/2015 Goudarzi et al.
9,333,390 B1 * 5/2016 Manwaring ..... A63B 24/0003
2002/0010034 A1 1/2002 Reyes et al.
2005/0079932 A1 * 4/2005 Voges ..... A63B 69/3658 473/407
2005/0277483 A1 * 12/2005 Peterson ..... A63B 60/42 473/282
2006/0122004 A1 6/2006 Chen et al.
2006/0166757 A1 * 7/2006 Butler, Jr. ..... A63B 53/0466 473/334
2007/0249432 A1 10/2007 Wu
2009/0203464 A1 8/2009 Stoner
2010/0016098 A1 1/2010 Tavares et al.
2012/0108363 A1 * 5/2012 Hasegawa ..... A63B 60/42 473/409
2012/0165115 A1 * 6/2012 Matsunaga ..... A63B 53/04 473/336
2012/0196692 A1 * 8/2012 Beck ..... A63B 60/00 473/221
2012/0329571 A1 12/2012 Stites
2013/0196784 A1 8/2013 Clausen et al.
2014/0031142 A1 * 1/2014 Billings ..... A63B 60/02 473/335
2016/0074720 A1 * 3/2016 Kline ..... A63B 53/08 473/223

* cited by examiner

GOLF CLUB HEAD WITH INTERIOR WEIGHT ADJUSTABLE IN MULTIPLE DIRECTIONS

CROSS-REFERENCE TO RELATED APPLICATIONS

The present application is a continuation of U.S. application Ser. No. 15/987,520 entitled GOLF CLUB HEAD WITH INTERIOR WEIGHT ADJUSTABLE IN MULTIPLE DIRECTIONS filed on May 23, 2018 and issued as U.S. Pat. No. 10,398,594 on Sep. 3, 2019, which is a continuation of U.S. application Ser. No. 15/296,964 entitled GOLF CLUB HEAD WITH INTERIOR WEIGHT ADJUSTABLE IN MULTIPLE DIRECTIONS filed on Oct. 18, 2016 and issued as U.S. Pat. No. 9,987,535 on Jun. 5, 2018, which is a divisional of U.S. application Ser. No. 14/488,140 entitled GOLF CLUB HEAD WITH INTERIOR WEIGHT ADJUSTABLE IN MULTIPLE DIRECTIONS filed Sep. 16, 2014.

STATEMENT RE: FEDERALLY SPONSORED RESEARCH/DEVELOPMENT

Not Applicable

BACKGROUND OF THE INVENTION

1. Field of the Invention

The present disclosure pertains generally to golf clubs and, more particularly, to a golf club head that includes an adjustable internal weight for customizing the structural properties of the club head based on the swing characteristics of a user.

2. Description of the Related Art

It is understood that the structural properties of a golf club head have a significant effect on the overall performance of the golf club. Therefore, when designing a golf club, careful consideration is given to structural features, such as the overall weight of the club head, as well as the center of gravity, to name a few. Conventional club heads have fixed structural properties, i.e., the weight and center of gravity cannot be changed. Therefore, most club heads are designed to maximize performance based on defined swing characteristics. However, all golfers do not have the same swing characteristics, particularly those swing characteristics which maximize the performance of an individual club head. For instance, one golfer may have swing characteristics that would benefit by having the center of gravity of the club head moved to a forward location, while another golfer may have swing characteristics which would benefit by having a club head having a center of gravity that is located in a more rearward location.

In view of the correlation between the structural properties of the club head and the performance of the club by a particular user, various club manufacturers have made several attempts at designing club heads that enable certain degrees of adjustability in relation to the structural properties of the club. For instance, certain club heads have been developed which are adapted to receive weighted inserts for adjusting the weight distribution and corresponding center of gravity of the club. Heavier or lighter inserts may be swapped with each other to adapt the structural properties of the club to maximize the performance thereof based on the user's swing. Another adjustable feature incorporated into some existing club heads is a threaded weight coupled to the club head along a corresponding threaded shaft. By rotating the weight relative to the shaft, the position of the weight may be adjusted in one direction. Other club head designs include externally located slots which are adapted to receive weights which are selectively positionable within and along the slots, again in one direction.

Although the existing features which enhance the structural adaptability of the club are improvements over previous club heads having fixed structural characteristics, there are several deficiencies associated with the existing features. One significant deficiency is that most structural adjustability features are limited to adjustment along one or two axes, or adjustment within a single plane. Adjustment within a single plane severely limits the possible range of motion of the weight, and the corresponding effect the adjustment may have on the performance of the club. Another deficiency commonly associated with adjustable features which are externally located is that they may easily break during the normal course of using the golf club. For instance, if the golfer inadvertently strikes the ground, the weights may break or dirt may enter the club, weight, or weight port and impede subsequent adjustment of the weight.

In view of the aforementioned deficiencies in the art, there is a need for a club head having an adjustable weight that is adjustable beyond a single plane or axis to enhance the overall range of the weight.

BRIEF SUMMARY OF THE INVENTION

Various aspects of the present disclosure are directed toward a golf club head having a weight contained within the club head and adjustable along three axes, i.e., in three dimensions. The ability to adjust the weight along three axes allows for significant enhancement of the overall performance adjustment of the club relative to conventional clubs which may include an adjustment mechanism limited to motion in a single plane or along a single axis.

According to one embodiment, the golf club head includes a striking face, and a body coupled to the striking face. The body includes a crown, a sole disposed in generally opposed relation to the crown, and a back extending away from the striking face. The striking face and body collectively define a hollow interior chamber. A weight is disposed entirely within the interior chamber. An adjustment mechanism is coupled to the body and the weight to enable adjustment of the weight along three axes.

The golf club head may additionally include a window coupled to the body and configured to enable viewing of the adjustable weight within the interior chamber. At least two indicia may be formed on the window, wherein each of the at least two indicia are representative of a location of a center or gravity of the golf club head.

The adjustment mechanism is externally accessible through an opening formed in the body. The adjustment mechanism may comprise a ball-in-socket joint connected to the weight. The weight may be positioned on an arm that may be slidably or threadably positioned within a sleeve, enabling axial adjustment of the weight along one axis. The ball-in-socket joint may comprise a ball having a channel therethrough in communication with a corresponding channel formed in the sleeve. The ball-in-socket joint may comprise a ball and a socket, wherein the ball and socket include a plurality of complimentary detents and protrusions adapted to engage with each other in a mating fashion. The socket may be biased against the ball. A sleeve may be connected to the ball-in-socket joint, and an arm may be axially received within the sleeve and connected to the weight. The sleeve may comprise internal threads that engage external threads on the arm.

The golf club head may additionally include a clamping mechanism adapted to enable the adjustment mechanism to assume a fixed position relative to the body.

The golf club head may further include a sensor coupled to or disposed within the weight and configured to generate and emit an electronic signal associated with the position of the weight within the interior chamber.

The adjustment mechanism may include at least two adjustable struts extending between the body and the weight.

According to another embodiment, there is provided a method of fabricating a golf club. The method includes receiving a request to fabricate a customized golf club head, wherein the request includes instructions to position a weight entirely within a hollow interior chamber of the customized golf club head in a predefined position. The predefined position includes three coordinates including a face-to-back coordinate, a sole-to-crown coordinate, and a heel-to-toe coordinate. The three coordinates have been previously determined via a fitting operation during which an adjustable weight disposed entirely within a hollow interior chamber of a fitting club and adjustable in a sole-to-crown direction, a face-to-back direction, and a direction along a face of the fitting club was adjusted in order to determine a preferred position of the adjustable weight. The method further includes fabricating the customized golf club head by positioning the weight in the predefined position.

The fabricating step may comprise securing the weight within the interior chamber. The step of securing the weight may include permanently securing the weight to an interior wall of the golf club head. The weight may also be secured within the interior chamber by two struts.

The weight may be of predetermined mass, wherein the predetermined mass has been previously determined via the fitting operation.

The various exemplary aspects described above may be implemented individually or in various combinations. These and other features and advantages of the golf club head according to the disclosure in its various aspects and demonstrated by one or more of the various examples will become apparent after consideration of the ensuing description, the accompanying drawings, and the appended claims.

BRIEF DESCRIPTION OF THE DRAWINGS

The drawings described below are for illustrative purposes only and are not intended to limit the scope of the present invention in any way. Exemplary implementations will now be described with reference to the accompanying drawings, wherein.

Common reference numerals are used throughout the drawings and detailed description to indicate like elements.

DETAILED DESCRIPTION OF THE INVENTION

Figure 1:
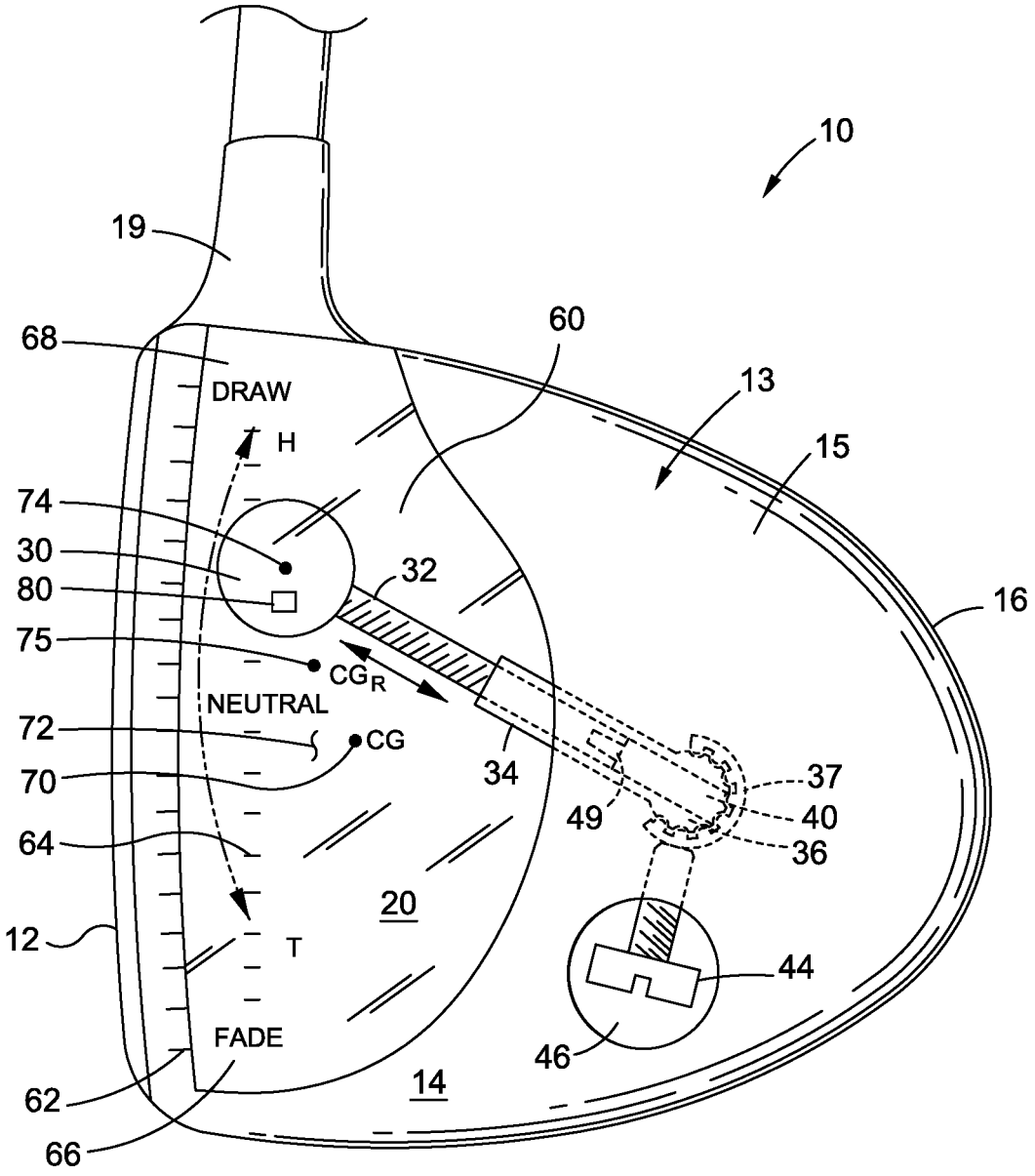
FIG. 1 is a bottom view of a first embodiment of a golf club head having an adjustable internal weight.
Figure 2:
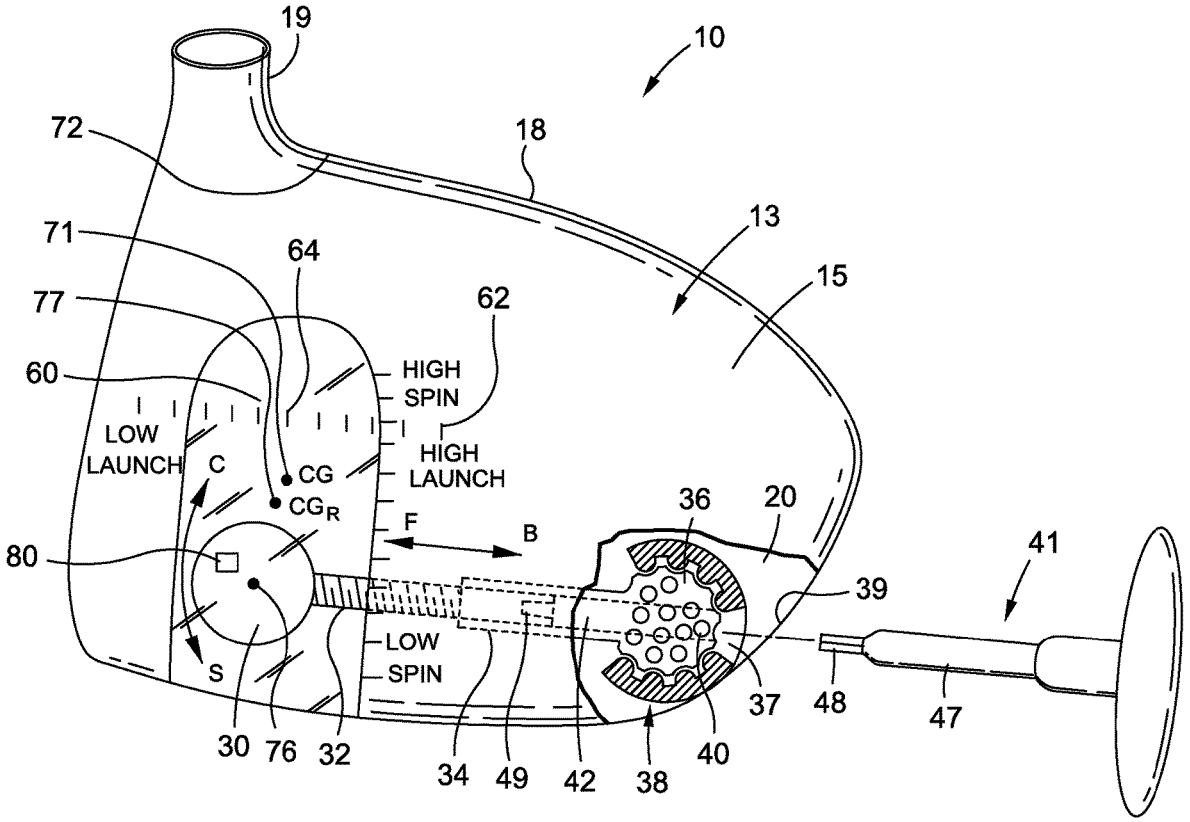
FIG. 2 is a side, partial cutaway view of the golf club head of FIG. 1.

Referring now to the drawings, wherein the showings are for purposes of illustrating various aspects of the present disclosure only, and not for purposes of limiting the same, in FIGS. 1 and 2, there is illustrated an aspect of the disclosure comprising a golf club head, generally 10, which may include exterior surfaces and structures comprising a striking face 12 with which to strike a golf ball (not shown). A club head body 13 is coupled to the striking face 12, and generally includes a sole portion 14 that may rest on or near the ground at address, a generally peripheral skirt portion 15 connected to the face 12 and sole portion 14. The skirt portion 15 includes a back portion 16, a crown portion 18, a hosel 19, and an interior portion comprising a hollow interior chamber 20, as is known in the art. As is also known in the art, the various components of the golf club head 10, including the striking face 12, club head body 13, sole portion 14, skirt portion 15, and back portion 16 may be separate components that may be joined using known attachment techniques such as welding, use of adhesives, screws, etc. Additionally or alternatively, one or more of the components may be fabricated as a unitary piece, i.e., by casting, forging, molding, etc., as is also known.

In the aspect of the disclosure illustrated in FIGS. 1-2, the golf club head 10 may comprise a weight 30 that may be disposed entirely within the interior chamber 20 such that the weight 30 would not normally be visible or adjustable if positioned inside a conventional golf club head. The weight 30 may be fabricated of any golf club weighting material, including by way of example, titanium, steel, aluminum, lead and other metals and alloys thereof, ceramic, resin, stone, concrete, etc. Although the weight 30 as illustrated in FIGS. 1 and 2 may be generally spherical, other shapes (for example, rectilinear, oval, trapezoidal, conical, cubic, etc.) are of course possible and contemplated by the present disclosure. A spherical weight 30, however, may be particularly advantageous as it may, incorporating the teachings herein, provide for more accurate adjustment of a golf club head's center of gravity, "CG," as will be subsequently described.

As further illustrated in FIGS. 1 and 2, the weight 30 may be connected to an adjustment mechanism which may comprise an arm 32, which may be threaded. The arm 32 may be slidably received within a sleeve 34, which may likewise be threaded to enable the arm 32 to be threaded in and out of the sleeve 34 upon the rotation of the arm 32 in respective ones of either clockwise or counter-clockwise directions. As illustrated, the arm 32 and/or sleeve 34 may enable the weight 30 to be selectively adjustable in a sole-to-crown direction, "S-C," a face-to-back direction, "F-B," and in a direction generally along the face, for example, a heel-to-toe direction, "H-T." As illustrated in FIG. 2, the weight 30 may be adjusted in multiple directions, for example, via a ball 36 which may be positioned on the distal end of the sleeve 34 and may be captured in a socket 38 having one or more socket arms 45, and in one aspect, having a pair of cooperating socket arms 45. The socket 38 is illustrated as one or more socket arms 45, but may also comprise a socket 38 integrally formed as part of the club head body 13. The socket 38 may additionally or alternatively be connected, for example, with welding, to an interior surface 39 of the golf club head 10. As best seen in FIG. 2, the ball 36 may be accessible from the exterior of the club head 10, with at least a portion of the ball 36 being accessible through an opening 37 in the golf club head 10, for example, in the sole 14 or skirt 15. In this aspect, the ball 36 and socket 38 may comprise a pivot enabling the sleeve 34, arm 32, and/or weight 30 to be adjusted to virtually any desired position within the interior chamber 20, limited only by the range of motion of the weight 30, sleeve 34, and/or ball 36 within the interior chamber 20 as defined by the interior walls of the club head 10.

As further illustrated in FIGS. 1 and 2, the ball 36 may comprise a channel 40 therethrough that may communicate with a channel 42 in the sleeve 34. The channel 40 in the ball 36 may permit an adjustment tool, generally 41, having an adjusting arm 47 to be used to adjust the weight 30. In this aspect, the adjusting arm 47 of the adjustment tool 41 may be positioned inside the channel 40, and manipulated to move the weight 30 into any desired position within the interior chamber 20 by pivoting the ball 36 within the socket 38. Once the desired position is achieved, the weight 30 may be fixed in place, for example, using a screw 44 to clamp down on the ball 40 and/or the socket 38. In the embodiment illustrated in FIG. 1, the screw 44 is illustrated as being clamped down on the socket 38 to compress the socket 38 against the ball 40 to fix the position of the ball 40 relative to the socket 38. To adjust the position of the ball 40 relative to the socket 38 for purposes of moving the weight 30 within the interior chamber 20, the screw 44 may be rotated in a first rotational direction to loosen the engagement between the socket 38 and the ball 40. When the weight 30 is in the desired position, the screw 44 may be rotated in a second direction (opposite to the first rotational direction) to once again clamp down onto the ball 40. The screw 44 may reside within a recess 46 positioned on the sole 14 or other external surface of the golf club head 10, for example, the skirt 15, wherein the shaft of the screw 44 may be threadably engaged with the club head 10. Other clamping mechanisms to secure the weight 30 in fixed position following adjustment, for example those employing an elliptical cam or other press/friction fitting clamp, such as found on bicycle wheel securing clamps, may be used; indeed any clamping or other securing mechanism adapted to enable the type of pivotal adjustment of an internally disposed weight within a golf club head and subsequent fixation of the weight in a desired position within the golf club head is contemplated within the scope of this disclosure.

As further illustrated in FIGS. 1 and 2, the adjustment tool may comprise a six-pointed, square, hexagonal, Phillips head, flat screwdriver, or other keyed male end 48 configured to mate with a female socket or slot 49 within the arm 32, enabling the adjustment tool 41 to turn the arm 32 rotationally and thereby screw the arm in and out of the threaded sleeve 34 to permit adjustment along the axis of the sleeve 34, in this case, generally in the face-to-back direction F-B as illustrated in FIG. 2.

Figure 3:
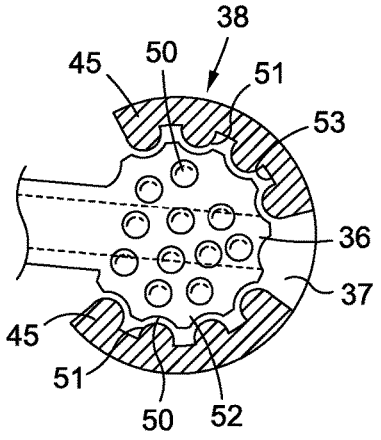
FIG. 3 is a partial sectional view of an adjustment mechanism which may be integrated into the golf club head shown in FIGS. 1 and 2.

As illustrated in FIG. 3, the ball 36 may include a plurality of indentations 50 and/or protrusions 52 configured to mate with corresponding protrusions 51 and/or indentations 53, respectively, in the socket 38. Such mating may be further achieved by biasing the socket 38 against the ball 36, enabling repositioning of the ball 36 within the socket 38 and temporary fixation thereof until the screw 44 or other clamping/securing mechanism is secured. The mating of indentations 50 and/or 53 with respective protrusions 51 and/or 52, may further secure the ball 36 within the socket 38, which may be important when the golf club head 10 is used to hit a golf ball, during which operation the club head 10 may achieve club head speeds of over 100 miles per hour, resulting in significant loading forces being experienced by the weight 30, arm 32, sleeve 34, ball 36, and socket 38, requiring that all such components be designed with sufficient strength, rigidity, and securing force to withstand such swing speeds and forces generated thereby upon impact with a golf ball.

As further illustrated in FIGS. 1 and 2, the golf club head 10 may comprise a substantially transparent window, 60, which may be fabricated of a high impact polymer or ballistic grade glass, for example, to enable the weight 30 to be viewed within the club head 10. The transparent window 60 may be attached to the body 13 of the club head 10 via an adhesive or other fastening technique known in the art. The viewing of the weight 30 through the window 60 may be advantageous, for example, to permit the weight 30 to be more accurately located in a desired position within the club head 10. To enable such positioning, the club head 10 may include external indicia 62 on the exterior of the club head 10 and/or internal indicia 64 on an interior wall of the club head 10 viewable through the window 60. Such indicia, 62, 64, may, for example be positioned substantially along the directions in which the weight 30 may be adjustable, for example, in the sole-to-crown direction S-C, a face-to-back direction F-B, and in a direction generally along the face, for example, a heel-to-toe direction H-T. As illustrated, such indicia 62, 64 may also include instructional cues 66, 68 for instructional purposes, in the example of FIG. 1, the terms "Fade" and "Draw," respectively, and generally corresponding to the direction the adjustable weight 30 should be moved to achieve more fade or draw of a struck golf ball. Similar indicia and instructional cues for achieving higher spin, for example, by moving the adjustable weight 30 in the direction S-to-C, and for achieving higher launch, for example, by moving the adjustable weight in the direction F-to-B, are illustrated in FIG. 2.

As also illustrated in FIGS. 1 and 2, the center of gravity CG of the golf club head 10 may be indicated on the exterior of the golf club head 10, for example, on the window 60, via a small circle or dot or other point indicator 70. The center of gravity CG is preferably indicated by at least two point indicators 70, each positioned along an imaginary line passing through the window 60 in different, preferably substantially perpendicular viewing directions, to enable visualization of the center of gravity in a three dimensional space. The point indicators 70 may optionally or additionally be positioned on an interior wall 72 of the golf club head 10 opposite the viewing window 30 through which the interior wall 72 is viewed. In the example of FIGS. 1 and 2, the window 30 (which may be multiple windows) is illustrated as a single piece that permits viewing into the interior chamber 20 in both the sole-to-crown direction (FIG. 1) and the heel-to-toe direction (FIG. 2). As illustrated, the weight 30 may also comprise one or more point indicators 74, 76, viewable through different views, for example, indicator 74 seen when viewing the weight 30 in the sole-to-crown direction, and indicator 76 seen when viewing the weight 30 in the heel-to-toe direction. Other viewing directions and windows for achieving them are of course now possible, including viewing in a crown-to sole direction, a back-to-face direction, a toe-to-heel direction, or even in a face-to-back direction if a transparent face 12 of sufficient strength and durability to withstand impact with a golf ball, for example, a face 12 fabricated of bullet-proof glass, is employed.

According to one aspect of the invention, a position sensor 80 is embedded within the weight 30 for determining the relative position of the weight 30 within the club head 10. In particular, the sensor 80 may emit a position signal which may be received by a remote receiver and analyzed to determine the precise position of the sensor 80 within the weight 30. The remote receiver may be any device capable of receiving the signal from the sensor 80 and analyzing the signal to determine the position information. It is contemplated that the remote receiver may include a personal computer (e.g., laptop or desktop), tablet computer (e.g., iPad™), smartphone, or other computing devices known by those skilled in the art. The information received by the remove receiver may be analyzed according to conventional position detection programs, software, algorithms and the like to determine the position of the weight 30 based on the signal received from the sensor 80. For instance, the analysis performed by the remote receiver may employ conventional triangulation techniques, such as those commonly used to identify the location of a cell phone. In this regard, the position sensor 80 may be employed to determine not only the relative position of the weight 30 within the golf club head 10, but may also comprise a sensor such as currently commercially available, for example, from Swingbyte, Inc., and others, and may be employed using software also available from such companies, to determine a golfer's swing speed, attack angle, swing plane, etc., for example during a fitting operation. Indeed, such sensors may be advantageously positioned and fixed within a fitting golf club head without employing the adjustment features described herein.

Figure 4:
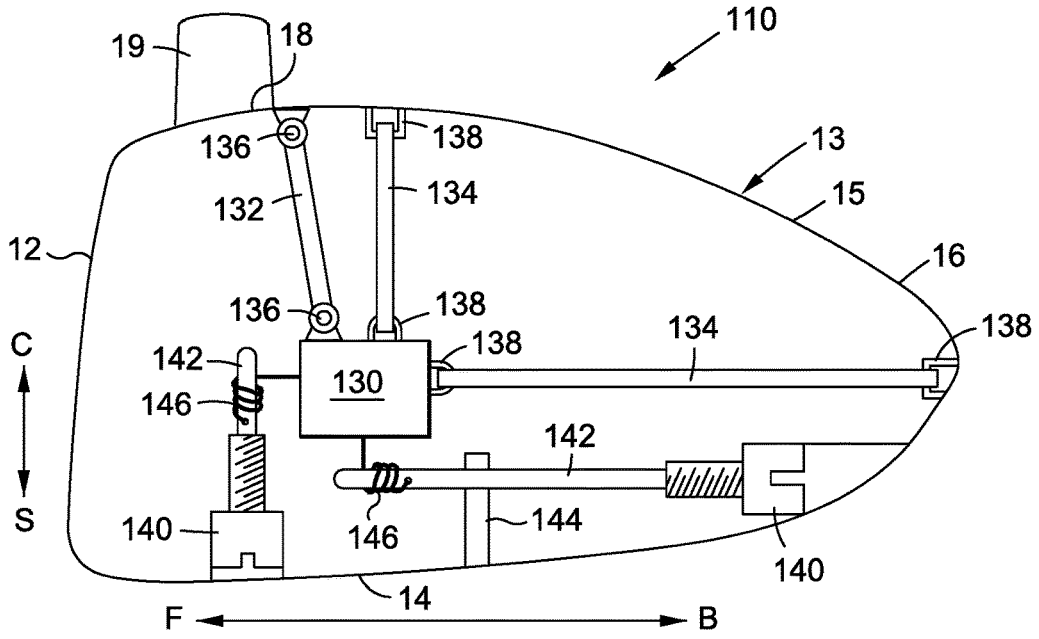
FIG. 4 is a side sectional view of a second embodiment of a golf club head having an adjustable internal weight.
Figure 5:
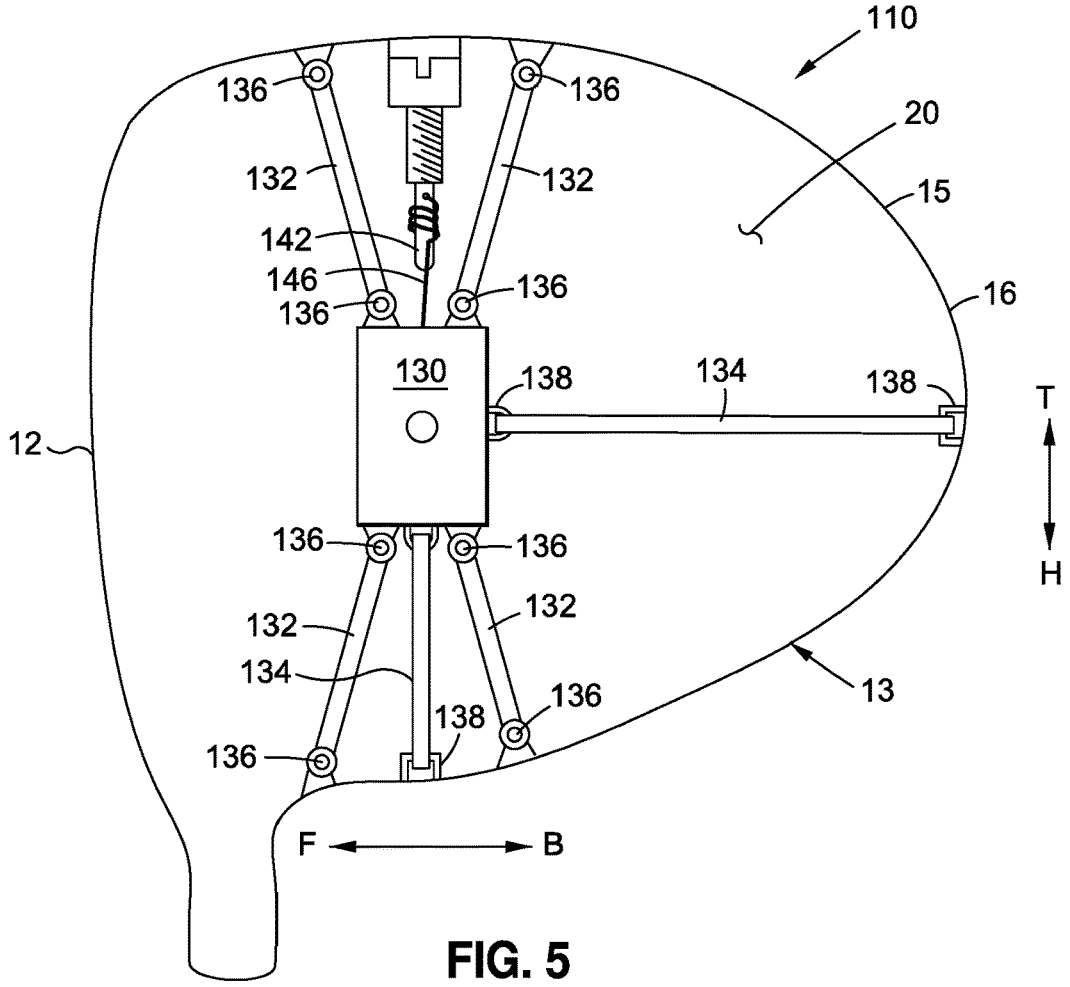
FIG. 5 is a top sectional view of the golf club head of FIG. 4.

Referring now to FIGS. 4 and 5, there is depicted a second embodiment of a golf club head 110 having an internal weight 130 entirely contained within a hollow interior chamber 20 defined by the golf club head 110. The primary distinction between the golf club head 110 shown in FIGS. 4 and 5 and the golf club head 10 shown in FIGS. 1 and 2 lies in the support and adjustment of the internal weight, as will be described in more detail below.

The golf club head 110 includes a striking face 12 and club head body 13, which collectively define the interior chamber 20, as described in more detail above. The weight 130 is disposed within the interior chamber 20 such that the weight 130 would not normally be visible or adjustable if positioned inside a conventional golf club head. The weight 130 may be fabricated of any golf club weighting material, including by way of example, titanium, steel, aluminum, lead and other metals and alloys thereof, ceramic, resin, stone, concrete, etc. Although the weight 130 as illustrated in FIGS. 4 and 5 is a hexahedron defining a quadrangular cross section, other shapes (for example, spherical, oval, trapezoidal, conical, cubic, etc.) are of course possible and contemplated by the present disclosure.

As further illustrated in FIGS. 4 and 5, the weight 130 may be connected to an adjustable support system, which may include a combination of adjustable struts 132 and elastomeric bands or springs 134. The struts 132 extend between the club head body 13 and the internal weight 130, and may be pivotable relative to both the club head body 13 and the internal weight 130 via hinges 136. The struts 132 are adapted to extend or contract in an axial direction in a telescoping fashion as the weight 130 is adjusted within the interior chamber 20. In this respect, the struts 132 may operate as piston-like shock absorbers, wherein the struts 132 maintain a prescribed length until a sufficient force is applied to either lengthen or shorten the length of the struts 132. The struts 132 may comprise a limited range of motion to both define the adjustability of the weight 130 and to limit the amount of recoil, if any, of the weight 130 upon impact of the club head body with a golf ball.

The elastomeric bands 134 may also extend between the club head body 13 and the internal weight 130, and are mounted to club head body 13 and internal weight via mounts 138. The elastomeric bands 134 are disposable in tension to apply a biasing force on the weight 130. In particular, as the length of the elastomeric bands 134 increases, the biasing force imparted on the weight 130 also increases. Conversely, as the length of the elastomeric bands 134 decreases, the biasing force imparted on the weight 130 also decreases. The inclusion of the elastomeric bands 134 is optional, and they may be omitted without departing from the spirit and scope of the present invention.

The golf club head 110 further includes an adjustment mechanism which may enable the weight 130 to be selectively adjustable in a sole-to-crown direction, "S-C," a face-to-back direction, "F-B," and in a direction generally along the face, for example, a heel-to-toe direction, "H-T." According to one embodiment, the adjustment mechanism includes one or more screws 140 which are adapted to engage with a screwdriver or other adjustment tool in a mating fashion for rotating the screws 140. Each screw 140 is coupled to a shaft 142 in a manner such that the shaft 142 rotates with the screw 140. Depending on the length of the shaft 142 and placement of the shaft 142 within the club head 110, the shaft 142 may be supported by a journal 144. Each shaft 142 is coupled to a cable 146, which is also coupled to the weight 130.

In use, the screws 140 may be individually turned, which either winds or unwinds the corresponding cable 146, resulting in movement of the weight 130. The golf club head 130 may include cables 146 which adjust the weight 130 along three discrete axes to maximize adjustment of the weight 130 within the interior chamber 20. The struts 132 and elastomeric bands 134 also adjust their respective configurations in response to movement of the weight to collectively support the weight 130 in the desired position suspended within the interior chamber 20.

It should be noted that although the club head 110 depicted in FIGS. 4 and 5 show an embodiment of the club head 110 having both struts 132 and elastomeric bands 134 for supporting the weight 130 within the interior chamber 20, it is contemplated that other embodiments of the club head 110 may employ only struts 132 or only elastomeric bands 134 for supporting the weight 130. Of course, springs (not shown) of sufficient durability and tensile strength may be employed in conjunction with or in place of the elastomeric bands 134 and/or struts 132.

In another aspect of the disclosure, an adjustable weight as described herein may be used in a fitting operation to customize a golf club to a particular player. As is known, even professional golfers, the best in the world, have different and unique swing characteristics, including, for example, swing speed, attack angle, tendency to draw or fade, etc. Because of these unique swing characteristics experienced by all golfers, personalized fittings are frequently employed to match the golfer to the club in an effort to achieve the best possible "fit" for the particular golfer.

Various devices are known for determining swing and other characteristics of golfers, including "Trackman" monitors that measure club head speed, backspin, side spin, launch angle, etc., and "Swingbyte" sensors that measure attack angle, swing plane, swing speed, etc. It is now possible, using one or more of these characteristics obtained through a fitting operation, to adjust the center of gravity of a fitting club that comprises an adjustable weight disposed entirely within the hollow interior chamber of the fitting club and adjustable in a sole-to-crown direction, a face-to-back direction, and/or a direction along a face of the fitting club in order to determine a preferred position of the adjustable weight.

For example, during a fitting operation for a driver for golfer A, a fitting club comprising a golf club head 10 as described herein may initially position the adjustable weight 30 in a "neutral" position, in other words, with the point indicators 74, 76, substantially aligned with the CG point indicators 70, 71, respectively. It may then be determined, after a statistically significant number of swings using, for example, a Trackman launch monitor, and a golf club head 10 with an adjustable weight 30 thus neutrally positioned, that is, positioned in alignment with the club head 10's center of gravity CG (that is, a center of gravity for the club head 10 assuming no adjustable weight 30 was installed) that golfer A on average experiences 3,000 rpm of slicing side spin. The fitting professional may, in such a scenario, recommend adjusting the adjustable weight 30 toward the heel, in the toe-to-heal direction T-H, as illustrated in FIG. 1, such that the resulting center of gravity CGR, indicated at points 75 in FIGS. 1 and 2, is shifted into a heel-ward position more likely to result in a draw, or at least less slicing side spin. The same fitting operation may alternatively or additionally result in a determination that golfer A's swing results in too much backspin and/or too high of a launch angle, which may be corrected for by adjusting the adjustable weight 30 downwardly in the crown-to-sole direction, and forwardly in the back-to-face direction, moving the resulting CGR depicted as point 77 in FIG. 2 downward and forward relative to the original CG, depicted as point 71.

This procedure (i.e., perform a number of swings, determine a pattern of ball flight based thereon, and adjust the adjustable weight in an effort to correct the resulting ball flight) may be repeated until an optimal position of the resulting CGR for golfer A using the fitting club is determined. Such optimal position may be recorded with reference to the various visual indicators 62, 64, or using a position sensor as previously described. This procedure may also include swapping out adjustable weights 30 of different mass, for example, by accessing the weight 30 through a removable port cover in the golf club 10 of the fitting club (not shown).

It is contemplated that, as a result of the fitting operation such as previously described, the golfer may walk out of the fitting studio with an adjustable club head substantially as described and customized. It is also an aspect of the disclosure that the customized position of the resulting center of gravity CGR may be communicated to a golf club manufacturer for purposes of manufacturing either an adjustable or non-adjustable golf club with that resulting center of gravity CGR. In the case of a non-adjustable golf club, the weight 30 may be positioned within the hollow interior chamber, for example, by permanently securing the weight 30 to an interior wall of the golf club head 10. Such permanent securing may be achieved, for example, using one or more struts attached to the interior walls of the golf club head 10, such that the struts may bridge the weight 30 at the predetermined position relative to the club's hollow interior chamber.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure. For example, while the figures illustrate only one adjustable weight, it will now be appreciated that multiple adjustable weights may be placed within a golf club head according to the teachings herein. Similarly, while the figures illustrate only an internally disposed adjustable weight, it will now be appreciated that such an adjustable weight may be employed in conjunction with known external adjustable weights, including those that slide, are threaded, etc.

What is claimed is:

1. Performing a golf club fitting operation for a user via a fitting club including a fitting club head, the fitting operation comprising the steps of:

a.) establishing a first center of gravity (CG) location of the fitting club;

b.) monitoring one or more swings of the fitting club by the user to determine a preferred CG location for the user comprising a second CG location;

c.) externally adjusting the first CG location via an internally-disposed adjustable weight of the fitting club, the weight being adjustable in a sole-to-crown direction, a face-to-back direction, and a heel-to-toe direction of the fitting club to approximate the second CG location, the adjustable weight being adjusted into the second CG location using an adjustment mechanism within the fitting club head comprising an arm connected to the adjustable weight, the arm being adjustably disposed within a sleeve connected to a pivot to enable the adjustable weight to be adjusted axially along an axis of the sleeve and pivotally via the pivot;

d.) monitoring one or more additional swings of the fitting club by the user to determine if at least one of the additional swings establishes that the second CG location comprises the preferred CG location for the user; and e.) if at least one of the additional swings establishes that the second CG location comprises the preferred CG location for the user in step (d):

i. communicating the second CG location to a golf club manufacturer, and ii. fabricating a golf club including a customized golf club head having a CG location approximating the second CG location.

2. The fitting operation of claim 1 wherein step (e)(ii) comprises securing a weight within the customized golf club head in a predefined position corresponding to the second CG location.

3. The fitting operation of claim 2 wherein step (e)(ii) comprises securing the weight within an interior chamber defined by the customized golf club head.

4. The fitting operation of claim 3 wherein step (e)(ii) comprises permanently securing the weight to an interior wall of the customized golf club head which at least partially defines the interior chamber.

5. The fitting operation of claim 3 wherein step (e)(ii) comprises providing the weight to be of predetermined mass which is previously determined via at least one of steps (c) and (d).

6. The fitting operation of claim 1 wherein step (c) comprises adjusting the adjustable weight into the second CG location using a sensor positioned within the adjustable weight.

7. The fitting operation of claim 1 wherein step (a) comprises monitoring one or more swings of the fitting club by the user.

8. The fitting operation claim 1 wherein step (c) comprises adjusting the adjustable weight into the second CG location using an adjustment mechanism wherein the sleeve is connected to a ball and socket joint.

9. Performing a golf club fitting operation for a user via a fitting club including a fitting club head, the fitting operation comprising the steps of:

a.) establishing a first center of gravity (CG) location of the fitting club;

b.) monitoring one or more swings of the fitting club by the user to determine a preferred CG location for the user comprising a second CG location;

c.) externally adjusting the first CG location via an internally-disposed adjustable weight of the fitting club, the weight being adjustable in a sole-to-crown direction, a face-to-back direction, and a heel-to-toe direction of the fitting club to approximate the second CG location, the adjustable weigh being adjusted into the second CG location using an adjustment mechanism within the fitting club head comprising an arm connected to the adjustable weight, the arm being adjustably disposed within a sleeve connected to a pivot to enable the adjustable weight to be adjusted axially along an axis of the sleeve and pivotally via the pivot;

d.) monitoring one or more additional swings of the fitting club by the user to determine if at least one of the additional swings establishes that the second CG location comprises the preferred CG location for the user; and e.) if at least one of the additional swings establishes that the second CG location comprises the preferred CG location for the user in step (d), communicating the second CG location to a golf club manufacturer.

10. The fitting operation of claim 9 wherein step (c) comprises adjusting the adjustable weight into the second CG location using a sensor positioned within the adjustable weight.

11. The fitting operation of claim 9 wherein step (a) comprises monitoring one or more swings of the fitting club by the user.

12. The fitting operation claim 9 wherein step (c) comprises adjusting the adjustable weight into the second CG location using an adjustment mechanism wherein the sleeve is connected to a ball and socket joint.

13. Performing a golf club fitting operation for a user via a fitting club including a fitting club head, the fitting operation comprising the steps of:

a.) establishing a first center of gravity (CG) location of the fitting club;

b.) monitoring one or more swings of the fitting club by the user to determine a preferred CG location for the user comprising a second CG location;

c.) externally adjusting the first CG location via an internally-disposed adjustable weight of the fitting club head, the weight being adjustable in a sole-to-crown direction, a face-to-back direction, and a heel-to-toe direction of the fitting club head to approximate the second CG, the adjustment of the adjustable weight into the second CG location being facilitated through the use of an adjustment mechanism within the fitting club head comprising an arm connected to the adjustable weight, the arm being adjustably disposed within a sleeve connected to a pivot to enable the adjustable weight to be adjusted axially along an axis of the sleeve and pivotally via the pivot;

d.) monitoring one or more additional swings of the fitting club by the user to determine if at least one of the additional swings establishes that the second CG location comprises the preferred CG location for the user; and e.) if at least one of the additional swings establishes that the second CG location comprises the preferred CG location for the user in step (d), fabricating a golf club including a customized golf club head having a CG location approximating the second CG location.

14. The fitting operation of claim 13 wherein step (c) comprises adjusting the adjustable weight into the second CG location using a sensor positioned within the adjustable weight.

15. The fitting operation of claim 13 wherein step (a) comprises monitoring one or more swings of the fitting club by the user.

16. The fitting operation claim 13 wherein step (c) comprises adjusting the adjustable weight into the second CG location using an adjustment mechanism wherein the sleeve is connected to a ball and socket joint.

* * * * *